US008293042B2

(12) United States Patent
Lorentz

(10) Patent No.: US 8,293,042 B2
(45) Date of Patent: Oct. 23, 2012

(54) ARTICLES COMPRISING FIBRES AND/OR FIBRIDS, FIBRES AND FIBRIDS AND PROCESS FOR OBTAINING THEM

(75) Inventor: Vincent Lorentz, Bergholtz (FR)

(73) Assignee: Kermel, Colmar (FR)

( * ) Notice: Subject to any disclaimer, the term of this patent is extended or adjusted under 35 U.S.C. 154(b) by 0 days.

(21) Appl. No.: 13/156,027

(22) Filed: Jun. 8, 2011

(65) Prior Publication Data

US 2012/0001359 A1 Jan. 5, 2012

Related U.S. Application Data

(60) Division of application No. 12/195,950, filed on Aug. 21, 2008, now abandoned, which is a continuation of application No. 10/526,676, filed as application No. PCT/FR03/02495 on Aug. 8, 2003, now Pat. No. 7,459,407.

(30) Foreign Application Priority Data

Sep. 4, 2002 (FR) ..... 02 10913

(51) Int. Cl.
*D04H 1/54* (2012.01)
*D04H 3/14* (2012.01)

(52) U.S. Cl. ..... 156/62.2; 156/181; 156/308.2; 156/309.6; 525/420; 525/537; 525/906

(58) Field of Classification Search ..... 156/62.2, 156/181, 308.2, 309.6; 525/420, 535, 537, 525/906

See application file for complete search history.

(56) References Cited

U.S. PATENT DOCUMENTS

| | | | |
|---|---|---|---|
| 3,523,061 | A | 8/1970 | Purvis |
| 3,534,003 | A | 10/1970 | Hoback et al. |
| 3,956,561 | A | 5/1976 | Anderson et al. |
| 3,985,934 | A | 10/1976 | Farrissey et al. |
| 4,552,990 | A | 11/1985 | Persson et al. |
| 4,703,081 | A | 10/1987 | Blackwell et al. |
| 4,780,359 | A | 10/1988 | Trask et al. |
| 4,960,549 | A | 10/1990 | Brooks et al. |
| 5,093,435 | A | 3/1992 | Harris et al. |
| 5,149,749 | A | 9/1992 | Blackwell et al. |
| 5,164,460 | A | 11/1992 | Yano et al. |
| 5,173,524 | A | 12/1992 | Satoh |
| 5,274,875 | A | 1/1994 | Chou |
| 5,295,406 | A | 3/1994 | Alfano |
| 6,838,401 | B1 | 1/2005 | Murayama et al. |

FOREIGN PATENT DOCUMENTS

| | | |
|---|---|---|
| EP | 648812 | 4/1995 |
| JP | 05-321026 A | 12/1993 |
| WO | WO 02/12619 A1 | 2/2002 |

OTHER PUBLICATIONS

Patent Abstract and Machine Translation for JP 05-321026, Takahiro et al.

Kapantaidakis G C et al. "High Flux Polyethersulfone-Polyimide Blend Hollow Fiber Membranes for Gas Separation" Journal of Membrane Science, Elsevier Scientific Publ. Company, Amsterdam, NL, vol. 204, No. 1-2, Jul. 15, 2002, pp. 153-171.

*Primary Examiner* — Michael Tolin

(74) *Attorney, Agent, or Firm* — Millen, White, Zelano & Branigan, P.C.

(57) ABSTRACT

The present invention relates to novel articles, especially non-woven articles comprising fibers and/or fibrids. It also relates to novel fibers and fibrids and to a process for obtaining these fibers and fibrids.

22 Claims, 1 Drawing Sheet

ARTICLES COMPRISING FIBRES AND/OR FIBRIDS, FIBRES AND FIBRIDS AND PROCESS FOR OBTAINING THEM

This application is a divisional application of parent application Ser. No. 12/195,950 filed Aug. 21, 2008, now abandoned which is a continuation of application Ser. No. 10/526,676 filed Mar. 4, 2005 now U.S. Pat. No. 7,459,407, which is a National Stage Application of PCT International application PCT/FR03/02495 filed Aug. 8, 2003, and claiming priority of French application 0210913 filed Sep. 4, 2002, all of said applications being incorporated by reference herein.

The present invention relates to novel articles, especially non-woven articles comprising fibres and/or fibrids. It also relates to novel fibres and fibrids and to a process for obtaining these fibres and fibrids.

Particularly in the electrical insulation field, the aim is to obtain products exhibiting good temperature resistance and good mechanical properties and/or dielectric properties. These products may, for example, be non-woven articles produced from thermally stable fibres. In such an article, good cohesion of the thermally stable fibres is necessary for obtaining a good level of mechanical properties, or indeed also a uniform and dense structure of the article in order to obtain dielectric properties. For this purpose, the aim is to obtain good cohesion of the thermally stable fibres within the article. The aim is also to obtain a uniform and compact structure within the article. These articles, depending on their structure (especially their density) and/or their formulation, may have a mechanical and/or dielectric reinforcement function.

Document U.S. Pat. No. 2,999,788 proposes, for example, the preparation of synthetic polymer particles or "fibrids" having a particular structure, that can be used with fibres based on synthetic polymers, for the production of coherent fibrous structures by a papermaking process. A hot-pressing operation may be carried out on these structures, causing the fibrids to undergo plastic flow. However, the preparation of such fibrids, carried out by precipitation in a sheared medium, is complicated and expensive. These fibres must also remain in aqueous medium in order to be used directly. Consequently, they can neither be isolated nor transported easily, which limits their use.

Document FR 2 163 383 proposes to prepare non-woven articles formed by a web of fibres based on a non-melting material or one having a melting point above 180° C., the fibres being bonded together by means of a polyamide-imide bonding agent used in a proportion of 5 to 150% of the weight of dry fibres employed. However, the impregnation with resin is carried out in solution in a solvent, which consequently has deleterious effects on the characteristics of the non-wovens.

To improve the feasibility of non-woven webs, document FR 2 156 452 proposes to prepare non-woven webs by a wet route, the webs being formed from fibres made of a non-melting material or one having a melting point above 180° C., bonded together by a thermoplastic polymer in powder form.

Although in theory these webs can be obtained by a papermaking technique, industrial production of such webs is in fact difficult: this is because the compound comprising synthetic fibres and resin-based bonding agent has too low a cohesion to be able to be handled and in particular such a compound has insufficient cohesion to be able to be prepared dynamically, for example on a commercial papermaking machine; such webs are mainly able to be produced on laboratory apparatuses of the "Formette Franck" type, that is to say in a static and batch manner, as is apparent from the examples.

Document FR 2 685 363 proposes the wet preparation of a paper formed from fibres, having a thermal endurance at greater than or equal to 180° C., the fibres being bonded together by means of a fibrous bonding agent and a chemical bonding agent.

The use of bonding agents for ensuring fibre cohesion in articles, for example non-woven articles in particular, poses difficulties and incurs costs as regards the use of these bonding agents.

The present invention provides novel articles, especially non-woven articles, not having the above drawbacks, comprising fibres and/or fibrids. The invention also provides novel fibres and fibrids, and a process for obtaining these fibres and fibrids, and articles obtained from these fibres and fibrids, such as non-woven articles. The thermoplastic part of the fibre or fibrid of the invention acts in particular as the chemical bonding agent described above. In particular, it has the property of "undergoing plastic flow" under a compressive stress and temperature stress. This thus ensures the cohesion of the thermally stable fibres in these articles and their level of thermal and mechanical properties is very satisfactory. These articles may have a dense uniform structure, and therefore a good level of dielectric properties.

For this purpose, the first subject of the invention is an article comprising at least fibres and/or fibrids, characterized in that the fibres and fibrids are formed from a polymer blend comprising at least:

A thermally stable polymer; and

A thermoplastic polymer chosen from the group of polysulphides and polysulphones.

The second subject of the invention is a fibre and a fibrid such as those described above and a process for obtaining them.

In a third subject, the invention proposes the use of the articles as described above in the field of electrical insulation.

The thermally stable polymer of the invention is preferably a non-melting polymer or one having a glass transition temperature above 180° C., preferably greater than or equal to 230° C., or higher. The thermally stable polymer of the invention has a long-term thermal withstand (that is to say capability of retaining in particular its physical properties) at a temperature above 180° C. This thermally stable polymer is preferably chosen from polyaramids and polyimides. Mention may be made, as examples of polyaramids, of aromatic polyamides, such as the polymer known by the brand name Nomex®, or polyamide-imides, such as the polymer known by the brand name Kermel®. As an example of polyimides, mention may be made of the polyimides obtained according to document EP 0 119 185, known by the brand name P84®. The aromatic polyamides may be as described in Patent EP 0 360 707. They may be obtained using the process described in Patent EP 0 360 707.

The thermoplastic polymer is chosen from the group of polysulphides and polysulphones. As an example of a polysulphide, mention may be made of polyphenylene sulphide denoted hereafter by PPS. As an example of polysulphones, denoted hereafter by PSU, mention may be made of polyethersulphone denoted hereafter by PESU or polyphenylenesulphone denoted hereafter by PPSU.

These thermoplastic polymers have a glass transition temperature of less than or equal to 250° C., thereby allowing them to act in particular as a chemical bonding agent in the articles of the invention and allowing them to undergo "plastic flow" under a compressive stress and temperature stress.

These polymers also have good thermal stability, since they belong to a thermal class (thermal index) above 130° C. This is advantageous for obtaining articles exhibiting good thermal stability.

According to a preferred embodiment of the invention, the thermoplastic polymer and the thermally stable polymer are soluble in the same solvent. Advantageously, the solvent is an aprotic polar solvent. It is more preferably chosen from DMEU, DMAC, NMP and DMF.

Advantageously, the fibre or fibrid according to the invention comprises at least 10% by weight of thermoplastic polymer.

Fibrids are small non-granular fibrous particles or particles in the form of films that are not rigid. Two of their three dimensions are of the order of a few microns. Their small size and their flexibility allow them to be deposited in physically interlaced configurations, such as those commonly found in papers formed from pulp.

The fibre according to the invention preferably has a linear density of between 0.5 dtex and 13.2 dtex. The fibre of the invention preferably has a length of between 1 and 100 mm.

The fibre according to the invention may have varied cross-sectional shapes, such as a round, trilobate or "flat" shape. The term "fibre of flat cross-sectional shape" is understood to mean a fibre whose length/width ratio is greater than or equal to 2.

The fibre or fibrid according to the invention may be treated with a size.

According to one particular embodiment of the article of the invention, the fibres are obtained by blending the thermally stable polymer with the thermoplastic polymer, followed by spinning the blend.

Any means known to those skilled in the art for blending two polymers may be used. Preferably, the polymers are blended by dissolving the polymers in at least one common solvent. The thermoplastic polymer and the thermally stable polymer may be dissolved together, simultaneously or in succession, in a solvent or a mixture of mutually miscible solvents, for example in a single reactor. The polymers may also be dissolved separately in the same solvent or in different solvents that are mutually miscible, for example in two different containers, and then the polymer solutions are mixed together.

The dissolution conditions, such as the temperature, are determined by those skilled in the art according to the nature of the polymers and the solvent(s) that is (are) used. The dissolution may, for example, be carried out hot, with stirring, in order to facilitate the dissolution.

The dissolution may be carried out at room temperature. Preferably, the dissolution temperature is between 50 and 150° C.

The dissolving solvent(s) is (are) advantageously aprotic polar solvents. It is possible to use a dimethylalkylene urea, for example dimethylethylene urea (DMEU) or dimethylpropylene urea. Preferably, it is chosen from DMEU, dimethylacetamide (DMAC), N-methylpyrrolidone (NMP) and dimethylformamide (DMF). The dissolving solvent may be a mixture of aprotic polar solvents, for example a mixture of dimethylethylene urea and an anhydrous aprotic polar solvent, such as NMP, DMAC, DMF, tetramethyl urea or γ-butyrolactone.

The polymer solution obtained after dissolution is called collodion. The solution obtained is preferably clear.

The total concentration by weight of the polymers relative to the solution is preferably between 5 and 40%.

The solution may also include additives, such as pigments, reinforcing agents, stabilizers and delustrants.

The solution must also have a viscosity allowing it to be spun, generally between 100 and 1000 poise. For wet spinning, the viscosity is preferably between 400 and 800 poise, measured by means of a viscometer known by the brand name EPPRECHT RHEOMAT 15. For dry spinning, the viscosity is preferably between 1500 and 3000 poise.

The polymer blend may also be produced in-line during the spinning step, for example by the in-line injection of each polymer, whether or not dissolved in a solvent, during the spinning process.

Any method of spinning a polymer blend, especially a polymer solution, known to those skilled in the art may be used here within the context of the invention.

Mention may be made, for example, of dry spinning, in which the polymer solution (fibre-forming substance in the dissolved state) is extruded through capillaries in an environment favourable for the removal of the solvent, for example in an evaporating atmosphere maintained at a temperature close to or above the boiling point of the solvent, allowing the filaments to solidify. The filaments leaving the evaporating chamber are stripped of their residual solvent. To do this, they may be washed with water, optionally boiling water under pressure, and then they are usually dried, preferably at a temperature above 80° C. They may also be heat-treated at a temperature greater than or equal to 160° C. under reduced pressure and/or in an inert atmosphere. After having been stripped of their residual solvent, they may be drawn, for example at a temperature above 250° C., preferably greater than 300° C., preferably in the absence of oxygen.

According to one particular embodiment of the invention, the spinning method is a wet spinning method, in which the polymer solution (solution of fibre-forming substances) is extruded into a coagulating bath.

The temperature of the spinning solution may vary widely, depending on the viscosity of the solution to be spun. For example, a solution having a low viscosity may be easily extruded at ordinary temperatures, whereas for a solution having a high viscosity, it is preferable for this to be extruded hot, for example at 120° C. or even higher, so as to avoid excessively high pressures in the die. The spinning solution is advantageously maintained between 15 and 40° C., preferably between 15 and 25° C.

The coagulating bath used in the process according to the invention is preferably an aqueous solution containing from 30 to 80% by weight, preferably from 40 to 70% by weight, of a solvent or solvent mixture, preferably a dimethylalkylene urea (DMAU) or DMF, or a mixture thereof, although it is often advantageous to use a bath containing more than 50% by weight of solvent in order to obtain filaments having better drawability, and therefore better final properties.

Preferably, the polymers of the solution to be spun have similar coagulation rates.

The spinning rate in the coagulating bath may vary widely, depending on its solvent concentration and the distance that the filaments travel through this bath. This spinning rate in the coagulating bath may be readily chosen to be between, for example, 10 and 60 m/min, although higher rates can be achieved. It is generally not advantageous to spin at lower rates for process efficiency reasons. Moreover, excessively high spinning rates in the coagulating bath reduce the drawability of the filaments in air. The spinning rate in the coagulating bath will therefore be chosen to take into account both the efficiency and the desired properties of the finished filament.

The filaments leaving the coagulating bath in the gel state are then drawn, for example in air, with a draw ratio defined by $(V_2/V_1)\times100$, $V_2$ being the velocity of the drawing rolls and $V_1$ that of the feed rolls. The draw ratio of the yarns in the gel state is greater than 100%, preferably greater than or equal to 110% or even higher, for example greater than or equal to 200%.

After drawing, preferably in air, generally carried out by passage between two series of rolls, the residual solvent is removed from the filaments by known means, generally by means of a washing operation using water flowing countercurrently, or on washing rolls, preferably at room temperature.

According to another particular embodiment of the invention, the spinning method is a dry spinning method.

In the two spinning processes described above (dry spinning and wet spinning), the washed filaments are then dried by known means, for example in a dryer or over rolls. The temperature of this drying may vary widely, as may the drying rate, which is higher the higher the temperature. It is generally advantageous to carry out drying with a progressive rise in the temperature, this temperature possibly reaching and even exceeding 200° C. for example.

The filaments may then undergo hot overdrawing, in order to improve their mechanical properties and in particular their tenacity, which may be beneficial for some applications.

This hot overdrawing may be carried out by any known means: oven, plate, roll, roll and plate, preferably in a closed chamber. It is carried out at a temperature of at least 150° C., possibly a temperature of up to or even exceeding 200 to 300° C. The overdraw ratio is generally at least 150%, but it may vary widely depending on the desired properties of the finished yarn. The total draw ratio is therefore at least 250%, preferably at least 260%.

The combination of drawing and possibly overdrawing may be carried out in one or more stages, continuously or batchwise, with the above operations. Furthermore, the overdrawing may be combined with drying. To do this, all that is required is to provide, at the end of drying, a higher temperature zone for the overdrawing.

The filaments obtained are then chopped into fibres using a method known to those skilled in the art.

According to another embodiment of the article of the invention the fibrids are obtained by blending the thermally stable polymer with the thermoplastic polymer, followed by precipitation of the blend under a shear stress.

The thermally stable polymer/thermoplastic polymer blend may be produced in a manner similar to that described above for the fibres.

The fibrids of the invention may especially be obtained by precipitating a polymer solution in a fibridizing apparatus of the type described in U.S. Pat. No. 3,018,091, in which the polymers are sheared while they are precipitating.

According to a particular embodiment of the invention, the articles are non-woven articles. The non-woven articles are in the form of sheets, films or felts, and in general they define any coherent fibrous structure not involving any textile operation, such as spinning, knitting or weaving.

The article may be obtained from a single type of fibre or on the contrary from blends of fibres. The non-woven article of the invention comprises, at least in part, fibres and/or fibrids according to the invention. The article of the invention may comprise fibres of different kinds and/or fibrids of different kinds. Apart from the fibres and/or fibrids according to the invention, the non-woven article may comprise, for example, thermally stable or reinforcing fibres and/or fibrids of the para-aramid type, meta-aramid type, polyamide-imide type, etc.

The non-woven article may comprise, for example, fibres according to the invention and thermally stable fibres. If the article comprises fibrids, the article may, for example, comprise fibres according to the invention and fibrids of thermally stable polymer according to a first embodiment; or the article, may, for example, comprise thermally stable fibres and fibrids according to the invention according to another embodiment.

The non-woven article of the invention may be obtained by a method and an apparatus for preparing a non-woven article that are known to those skilled in the art. The article of the invention is generally obtained by carrying out a "web-forming" step, that is to say a step in which the fibres and/or fibrids are spread out over a surface, followed by a step of "consolidating" the structure obtained.

According to an advantageous embodiment of the invention, the "web-forming" step is carried out "dry" ("drylaid" process), for example starting in particular with fibres of the invention having a length of between 40 and 80 mm. The fibres may, for example, be treated using an ordinary carding machine.

According to another advantageous embodiment of the invention, the "web-forming" step is carried out "wet" or by "papermaking means" ("wetlaid" process). The fibres used in this embodiment generally have a length of between 2 and 12 mm, preferably between 3 and 7 mm, and their linear density, expressed in decitex, is generally between 0.5 and 20. Theoretically, it is possible to use fibres having a length greater than 12 mm, but in practice longer fibres entangle, requiring a larger amount of water, thereby making the process more expensive and more complicated.

According to this embodiment, the non-woven article is obtained by introducing the various constituents of the article into the water, namely the fibres and a fibrous bonding agent composed of a pulp based on a synthetic polymer having a thermal endurance at greater than or equal to 180° C. (such as a para-aramid pulp) and/or fibrids based on a synthetic polymer having a thermal endurance at greater than or equal to 180° C. and/or fibrids according to the invention, and optionally other desirable adjuvants, additives or fillers.

The pulp based on a synthetic polymer possessing a thermal withstand greater than or equal to 180° C. is generally obtained from fibres of usual length, especially fibrils, in a manner known per se, in order to give it a large number of catching points and thus increase its specific surface area. Among synthetic fibres, only highly crystallized fibres may be fibrilized. This is the case with completely aromatic polyamides and polyesters, but other highly crystallized polymers are able to be split along the fibre axis or are fibrilizable.

To improve certain properties, adjuvants, additives or fillers may also be used in various proportions depending on the desired properties; for example, mica may be introduced in order to further increase the dielectric properties of the article.

The "papermaking method" of preparing non-woven articles is known to those skilled in the art.

The step of "consolidation" of the structure obtained by web forming, as described above, may be carried out according to any method known to those skilled, in the art. Preferably, the "consolidation" is carried out thermally, for example by thermal pressing of the article. The thermal pressing temperature is generally greater than the glass transition temperature of the thermoplastic polymer of the fibres and/or fibrids according to the invention contained in the article. Preferably, the thermal pressing temperature is between the glass transition temperature and the softening temperature of the thermoplastic polymer.

According to one advantageous embodiment of the invention, the thermal pressing temperature is between 200 and 350° C. Preferably, the pressure is greater than or equal to 5 bar.

This pressing densifies and consolidates the article of the invention. It is generally accompanied by plastic flow of the thermoplastic polymer of the fibres and/or fibrids according to the invention contained in the article through the structure of the article.

There is no limitation imposed as to the way in which the thermal pressing is carried out. Any means of thermally pressing a non-woven article may be used.

For example, the pressing may be carried out using a press or a calender with heated rolls. It is possible to carry out several passes on the pressing apparatus so as to obtain the desired density.

The preferred thermal pressing method of the invention is calendering.

According to a particular embodiment of the invention, the thermal pressing is carried out using a continuous press.

The articles obtained by this pressing are various and varied depending on the thermal pressing conditions employed—especially the pressing temperature, pressure and time—and depending on the formulation of the article—especially the amount of fibres and/or fibrids according to the invention contained in the article and the amount of thermoplastic polymer present in these fibres and/or fibrids.

These parameters are chosen according to the type of article and the desired properties of this article.

The articles of the invention may be used especially in the electrical insulation field.

The role of the articles varies depending on their density and therefore on their strength/dielectric properties. They may for example, be used in an insulation system, in which the main, insulant is an oil or a resin, as a mechanical "spacer" or "reinforcement" to be inserted between two parts to be electrically isolated. The articles may also be used directly as insulant in insulation systems of the "dry" type.

The invention also relates to a fibre characterized in that it is formed from a polymer blend comprising at least:

A thermally stable polymer; and

A thermoplastic polymer chosen from the group of polysulphides and polysulphones;

and in that it has a linear density of less than or equal to 13.2 dtex.

The invention also relates to a fibrid, characterized in that it is formed from a polymer blend comprising at least:

A thermally stable polymer; and

A thermoplastic polymer chosen from the group of polysulphides and polysulphones.

Everything described relating to the thermally stable polymer, the thermoplastic polymer, the fibres and fibrids of the articles of the invention, the process for obtaining the fibres and the process for obtaining the fibrids applies here in the same way for the fibres and fibrids of the invention above.

The invention also relates, in a third subject, to the use of the articles of the invention as described above in the electrical insulation field.

Further details and advantages of the invention will become more clearly apparent in the light of the examples described below.

EXAMPLES

Examples 1 to 3

Preparation of the Thermopolastic Polymer/Thermally Stable Polymer Blend

Example 1

180 kg of DMEU solvent were introduced into a heated and stirred reactor. This solvent was firstly heated to a temperature of between 60° C. and 120° C. The PESU polymer (MW: 80 000 to 90 000 g/mol) in the form of lenticular granules was introduced into the hot solvent, in ten equal fractions. The time required between each fraction depended on the intensity of the stirring and the temperature. The polymer was introduced until it represented 20 to 40% by weight of the blend.

The polymer content in the solution influences its viscosity. As an example, at 21% the viscosity at 25° C. is 350 poise; at 28% the viscosity is 460 poise.

The PESU thermoplastic polymer was blended with the Kermel® polyamide-imide by melt blending, between 60 and 120° C., the blend described above containing the PESU and a 21 wt % solution of Kermel® polyimide-inside in the DMEU solvent (MW: 150 000 g/mol (polystyrene equivalent); viscosity: 600 poise at 25° C.). The proportion of the two solutions in the blend was expressed as the proportion of PESU polymer in the dry matter and was between 40 and 60%.

Example 2

A Kermel® polyamide-imide/PESU blend was obtained directly by dissolving the PESU polymer in a 13 wt % solution of Kermel® polyamide-imide in the DMEU solvent using a blender having a high shear rate and a high degree of recycling.

Example 3

A mixture containing the PESU was prepared according to the operating method of Example 1. The blend with the Kermel® polyamide-imide (in the form of a 21 wt % solution of Kermel® polyamide-imide in the DMEU solvent) was produced during the spinning, by conjointly injecting the two solutions into a common line, upstream of the static mixers installed in this line, which feeds the spinning unit. The proportions of the two solutions in the blend is respected by adjusting the rotation speeds of metering pumps.

Examples 4 and 5

Spinning of Thermoplastic Polymer/Thermally Stable Polymer Blends

Example 4

The PESU/Kermel® polyimide-imide blends of Examples 1 to 3 were spun using a wet spinning process. The proportion of PESU polymer was 40% by weight. The conditions below represent, as examples, the spinning parameters used:

Dies: 10 000 holes 50 μm in diameter

Coagulation bath: 55% solvent, 19° C.

Spinning rate: 14 m/min

Draw ratio: 2×

Final linear density obtained: 4.4 dtex.

The fibre was dried, crimped and chopped conventionally (fibre length: 60 mm).

Example 5

The PESU/Kermel® polyamide-imide blends of Examples 1 to 3 were spun using a wet spinning process. The proportion of PESU polymer was 50%. The conditions below represent, as examples, the spinning parameters used:

Dies: 10 000 holes 40 μm in diameter

Coagulation bath: 60% solvent, 19° C.

Spinning rate: 14 m/min
Draw ratio: 2×
Final linear density obtained: 2.2 dtex.

The fibre was dried conventionally. The crimping and chopping were carried out conventionally.

Examples 6 to 8

Articles

Non-woven articles of various grammages were prepared from the fibres of Example 4 using the "dry method" and by "consolidation" (carding, web forming, calendering) according to a method known to those skilled in the art.

The equipment employed was the following:
parallel-output Garnett®-type carding machine;
Asselin® web former;
KTM® calender.

Table 1 describes the operating conditions used and the characteristics of the articles obtained. The mechanical properties—strength and elongation at break—were measured according to the NF-EN 29073-3 standard of December 1992. The thickness of the articles was measured using a Palmer®-type micrometer.

TABLE 1

| | Examples | | |
|---|---|---|---|
| | Example 6 | Example 7 (*) | Example 8 |
| Calendering rate (m/min) | 5 | 5 | 5 |
| Calendering temperature (° C.) | 250 | 250 | 270 |
| Calendering pressure (bar) | 6 | 6 | 6 |
| Grammage (g/m$^2$) | 42 | 60 | 65 |
| Thickness (μm) | 50 | 65 | 70 |
| Density (g/cm$^3$) | 0.84 | 0.92 | 0.93 |
| Machine direction tensile strength (N/5 cm) | 20.2 | 41 | 60.9 |
| Machine direction elongation at break (%) | 1.4 | 2.1 | 2.9 |

(*) the article according to Example 7 was subjected to two calendering passes.

The plastic flow and the density obtained after calendering were observed.

Examples 9 to 12

Figure 1:
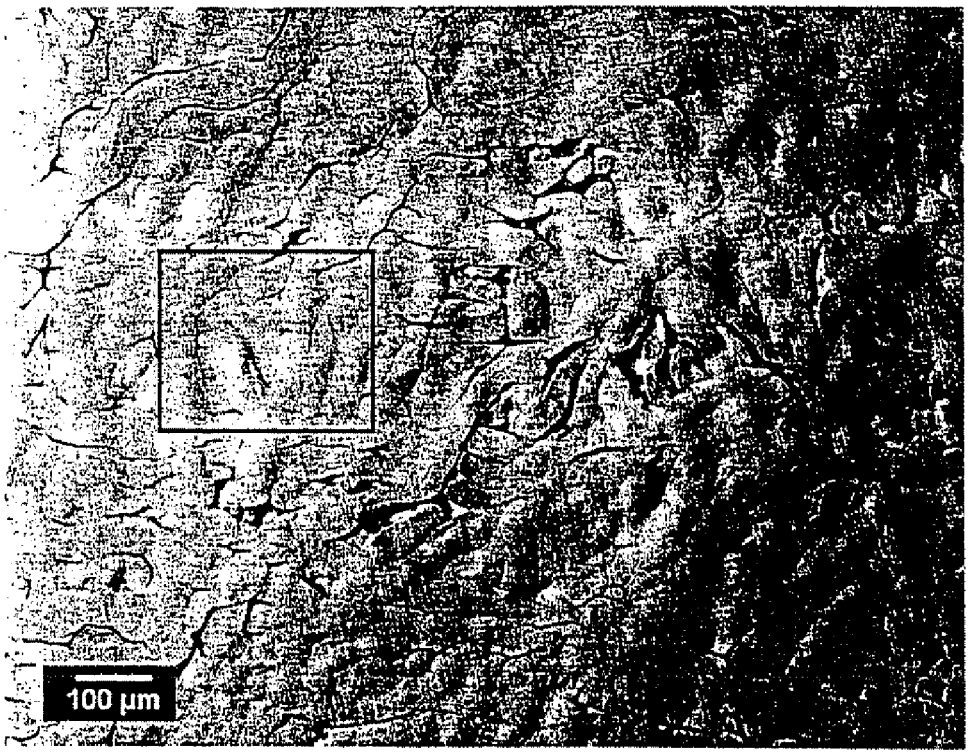
FIG. 1 is a photograph of the surface of the article according to Example 8 after calendering.
Figure 2:
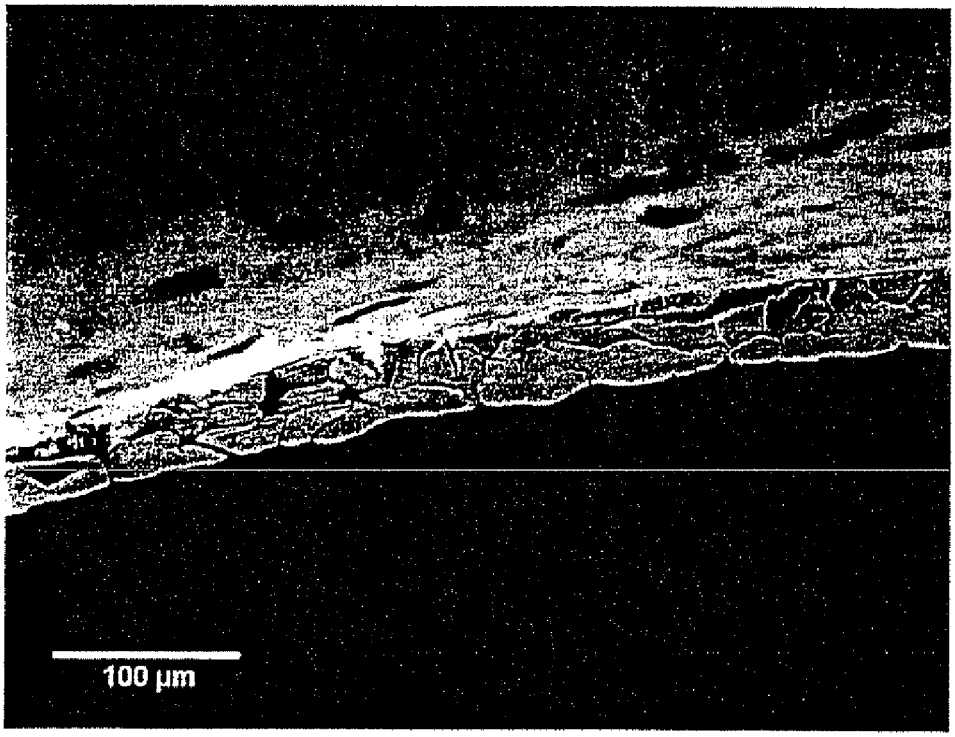
FIG. 2 is a photograph of the cross section of the article according to Example 8 after calendering.

Preparation of Fibrids from a Thermoplastic Polymer/Thermally Stable Polymer Blend The PESU/Kermel® polyamide-imide blend of Example 1, diluted with DMEU in order to obtain the desired concentration of PESU/Kermel® polyamide-imide polymers, was precipitated under high shear using a method as described in the documents FR 1214 126 or U.S. Pat. No. 4,187,143, in an aqueous coagulation bath having a given concentration of DMEU solvent. Table 2 gives the conditions for preparing the fibrids.

TABLE 2

| Examples | Proportion of PESU/Kermel ® polyamide-imide by weight (%) before precipitation | Proportion of the solvent in the coagulation bath by weight (%) |
|---|---|---|
| 9 | 9.5 | 25 |
| 10 | 15 | 50 |
| 11 | 9.5 | 0 |
| 12 | 9.5 | 50 |

The characteristics of the fibrids were measured on the MORFI apparatus (conventional apparatus for measuring papermaking cellulose fibres). Table 3 gives these characteristics.

TABLE 3

| | Examples | | | |
|---|---|---|---|---|
| | 9 | 10 | 11 | 12 |
| Length (mm) | 0.315 | 0.431 | 0.351 | 0.289 |
| Width (μm) | 40.2 | 44.6 | 49.7 | 30.3 |
| Fine elements (% by length) | 19.5 | 11.0 | 14.7 | 24.9 |
| Amount of fine elements (% by area) | 1.6 | 0.4 | 0.6 | 3.6 |

Examples 13 to 16

Articles Obtained from Fibrids

The fibrids of Examples 9 to 12 were blended with an equal weight of Kermel® polyamide-imide fibres 6 mm in length. These four preparations were used to produce papers on a Frank-type handsheet apparatus by wet processing and according to a conventional papermaking process. The intended weight of the specimens was 80 g/m$^2$. The characteristics of the papers are given in Table 4.

The retention factor was defined as follows:

Retention factor (%)=(1−[(mass introduced (g)−mass after passing through (g))/mass introduced (g)]×100.

TABLE 4

| Examples | Fibrids | Thickness in μm | Mass introduced into the apparatus (g) | Mass after passing through the apparatus (g) | Retention factor (%) | Grammage age (g/m$^2$) | Hand (cm$^3$/g) |
|---|---|---|---|---|---|---|---|
| 13 | Ex. 9 | 199.6 | 2.506 | 2.448 | 98 | 77 | 2.6 |
| 14 | Ex. 10 | 238.8 | 2.516 | 2.478 | 98 | 81 | 2.9 |

TABLE 4-continued

| Examples | Fibrids | Thickness in µm | Mass introduced into the apparatus (g) | Mass after passing through the apparatus (g) | Retention factor (%) | Grammage age (g/m²) | Hand (cm³/g) |
|---|---|---|---|---|---|---|---|
| 15 | Ex. 11 | 199.5 | 2.517 | 2.342 | 93 | 74 | 2.7 |
| 16 | Ex. 12 | 191.3 | 2.525 | 2.500 | 99 | 77 | 2.5 |

After drying, the papers obtained were characterized by their mechanical properties (Table 5) and by their air permeability in the Bendtsen apparatus at a pressure of 1.47 kPa (Table 6) using the conventional methods of the papermaking industry.

TABLE 5

Mechanical strength of the papers

| | Examples | | | |
|---|---|---|---|---|
| | 13 | 14 | 15 | 16 |
| Breaking force (N) | 1.78 | 2.37 | 1.05 | 3.23 |
| Tensile strength (N/m) | 119 | 158 | 70 | 216 |
| Tensile strength index (Nm/g) | 1.55 | 1.95 | 0.94 | 2.84 |
| Elongation at break (%) | 1.89 | 2.61 | 1.16 | 2.09 |
| Elastic modulus (MPa) | 558 | 370 | 638 | 632 |
| Tear strength (mN) | 820 | 1600 | 560 | 1400 |
| Tear Index (Nm/g) | 3.27 | 6.07 | 2.32 | 5.6 |

TABLE 6

Air permeability

| | Examples | | | |
|---|---|---|---|---|
| | 13 | 14 | 15 | 16 |
| Mean (ml/min) | 50.5 | 58.7 | 876.8 | 1.4 |
| Standard deviation | | 4.9 | 124.9 | 0.2 |

Examples 17 to 24

Hot-Pressed Articles Obtained Fibrids

The papers of Examples 13 to 16 were hot-pressed in a laboratory platen press at 280° C.:

either for 10 min at 100 bar or for 5 min at 200 bar.

TABLE 7

Thickness of the pressed papers

| | | Examples | | | |
|---|---|---|---|---|---|
| | | 17 | 18 | 19 | 20 |
| Pressure: 100 bar | Article | Ex. 13 | Ex. 14 | Ex. 15 | Ex. 16 |
| | Mean thickness (µm) | 125.8 | 137.3 | 125.7 | 121.5 |
| | Hand (cm³/g) | 1.63 | 1.69 | 1.69 | 1.57 |

TABLE 7-continued

| | | Examples | | | |
|---|---|---|---|---|---|
| | | 21 | 22 | 23 | 24 |
| Pressure: 200 bar | Article | Ex. 13 | Ex. 14 | Ex. 15 | Ex. 16 |
| | Mean thickness (µm) | 123.1 | 122 | 116.4 | 121.4 |
| | Hand (cm³/g) | 1.59 | 1.50 | 1.57 | 1.58 |

The invention claimed is:

1. A method for preparing a consolidated dense and substantially uniform article, wherein the article comprises thermostable fibers and/or fibrids formed from a blend of polymers comprising at least one thermostable polymer having a glass transition temperature greater than or equal to 230° C. and a thermoplastic polymer having a glass transition temperature of less than or equal to 250° C., said thermoplastic polymer being at least one polysulfide or at least one polysulfone, said method comprising forming an unwoven web of said fibers and/or fibrids and consolidating said web, said consolidating comprising heat pressing said web at a temperature above the glass transition temperature of said thermoplastic polymer, said thermoplastic polymer acting as a chemical bonding agent in said article to ensure cohesion of the thermostable fibers and/or fibrids.

2. A method according to claim 1, wherein the thermostable polymer is selected from the group consisting of aromatic polyamides, aromatic polyamide imides and polyimides.

3. A method according to claim 1, wherein the thermoplastic polymer is polyether sulfone or polyphenylene sulfone.

4. A method according to claim 1, wherein the thermoplastic polymer and the thermostable polymer are soluble in the same solvent.

5. A method according to claim 1, wherein the mixture of polymers comprises at least 10% by weight of the thermoplastic polymer.

6. A method according to claim 1, wherein the fibers are obtained by mixing the thermostable polymer and the thermoplastic polymer to form a mixture, followed by spinning the mixture.

7. A method according to claim 6, wherein the mixture is produced by dissolving the polymers in a solvent.

8. A method according to claim 7, wherein the solvent is a polar aprotic solvent.

9. A method according to claim 7, wherein the solvent is DMEU, DMAC, NMP or DMF.

10. A method according to claim 6, wherein the spinning is wet spinning.

11. A method according to claim 6, wherein the spinning is dry spinning.

12. A method according to claim 1, wherein the article comprises said fibrids and said fibrids are obtained by mixing the thermostable polymer and the thermoplastic polymer and then shear precipitating the mixture.

13. A method according to claim 1, wherein the heat pressing is performed at pressure and temperature conditions that impart plastic flow to at least the thermoplastic polymer.

14. A method according to claim 1, wherein during heat pressing, the temperature is in the range of 200° C. to 350° C., and the pressure is 5 bars or more.

15. A method according to claim 1, wherein the article further comprises additional fibers and/or fibrids which are thermostable.

16. A method according to claim 1, wherein the fibers have a size of 13.2 dtex or less.

17. A method according to claim 1, wherein the article is electrical insulation.

18. A method according to claim 1, wherein the thermostable fibers and/or fibrids are para-aramid, meta-aramid or polyamide imide fibers.

19. A method according to claim 1, wherein the consolidated fiber-based dense and substantially uniform article is free of mica.

20. A method according to claim 1, wherein the thermoplastic polymer is polyether sulphone or polyphenylene sulphone and the thermostable fibers and/or fibrids are para-aramid, meta-aramid or polyamide imide fibers.

21. A method according to claim 1, wherein said steps of forming an unwoven web and consolidating comprises carding, web forming and calendering.

22. A method according to claim 1, wherein said thermoplastic polymer is at least one polysulfide.

* * * * *